United States Patent [19]

Dahmen et al.

[11] Patent Number: 4,774,131

[45] Date of Patent: Sep. 27, 1988

[54] PROCESS FOR THE PRODUCTION OF POLYURETHANE-COATED TEXTILE SURFACES, POLYURETHANE-COATED TEXTILE SURFACES AND THEIR USE IN THE PRODUCTION OF BREATHABLE AND WATERPROOF CLOTHING

[75] Inventors: Kurt Dahmen, Monchen-Gladbach; Dolf Stockhausen, Krefeld; Karl-Heinz Stukenbrock, Nettetal, all of Fed. Rep. of Germany

[73] Assignee: Chemische Fabrik Stockhausen GmbH, Krefeld, Fed. Rep. of Germany

[21] Appl. No.: 105,944

[22] Filed: Oct. 2, 1987

[30] Foreign Application Priority Data

Oct. 4, 1986 [DE] Fed. Rep. of Germany ..... 3633874

[51] Int. Cl.[4] ..... B05D 7/00; B65D 3/10; B32B 27/12

[52] U.S. Cl. ..... 428/286; 427/245; 427/246; 427/342; 427/389.9; 428/91; 428/290

[58] Field of Search ..... 427/245, 246, 342, 412, 427/389.9; 428/91, 290, 286

[56] References Cited

U.S. PATENT DOCUMENTS

| | | | |
|---|---|---|---|
| 4,171,391 | 10/1979 | Parker | 427/246 |
| 4,535,009 | 8/1985 | Tangky et al. | 427/342 |
| 4,702,947 | 10/1987 | Pyll et al. | 427/246 |

FOREIGN PATENT DOCUMENTS

| | | | |
|---|---|---|---|
| 1009702 | 7/1974 | Japan | 427/246 |

*Primary Examiner*—Janyce A. Bell

*Attorney, Agent, or Firm*—Sprung Horn Kramer & Woods

[57] ABSTRACT

The present invention relates to a process for the production of textiles that are coated with polyurethane, in which the material that is to be coated is coated with two oppositely charged aqueous ionic dispersions of polyurethanes that contain no free isocyanate groups and contain covalently bonded, solubility-enhancing ionic groups, dried and optionally waterproofed. Cationic and anionic polyurethane dispersions are preferred in a weight ratio of 1:1, and are applied to the textile material in a two-coat technique, wet-on-wet. In addition, the invention relates to textile material produced in this way, with improved waterproof qualities and the use of such textiles for the production of breathable, water- and wind resistant clothing, industrial textiles, and leather substitutes, all of which are permeable to water vapour.

15 Claims, No Drawings

PROCESS FOR THE PRODUCTION OF POLYURETHANE-COATED TEXTILE SURFACES, POLYURETHANE-COATED TEXTILE SURFACES AND THEIR USE IN THE PRODUCTION OF BREATHABLE AND WATERPROOF CLOTHING

The present invention relates to a process for the production of textile structures that are coated with polyurethane, textiles that are coated with polyurethane, and the use of these for the production of breathable and waterproof clothing.

For sports, leisure, and rainwear there is an increasing demand for textiles that, on the one hand, are coated on the outside so as to be wind and water resistant and, on the other hand, allow moisture to escape from the inside to the outside. To this end, the textiles intended for these purposes are finished so as to be water repellent. When this is done, one achieves a good breathability and good water repellency (beading effect), but no impermeability to water. In recent years, several new developments have been proposed with the aim of improving this impermeability (see, for example, *Chemiefasern/Textileindustrie* (Chemical Fibre/Textile Industry), 36/88, 1986, p. 66). One possibility lies in coating or laminating a carrier or base material with films or microporous foils based on hydrophilic copolyesters or polyurethanes; at times, when this is done, porosity has to be created subsequently by fine perforation of the plastic web by means of electron irradiation. A further possibility lies in coating a carrier with a polyurethane that contains a solvent, with the formation of a compact, microporous PU layer. All of these processes entail disadvantages in that during lamination a solvent adhesive has to be used and during coating a solvent has to be used, and then subsequent processing involves increasing problems with regard to costs, combustibility, toxicity, and environmental contamination. For this reason, it has been proposed that costly lamination or ecologically questionable coating processes that use polymers containing solvents be replaced by coating with aqueous dispersions.

Such a process is described in DE-PS No. 29 31 125. In this process, a fibrous, porous web material is impregnated with an aqueous, ionic dispersion of a polyurethane with covalently bonded solubility-enhancing, ionizable groups and then coagulated with aqueous acid or caustic solutions. Such a method requires working with large quantities of liquids, first during the coagulation process itself, and then when washing out and neutralizing the coagulant that was used; this means that for this process one needs a large number of components which are not usually available in coating operations. In addition to this, the five-minute duration of the coagulation process is not in keeping with normal practical conditions because it renders rational production impossible. Furthermore, it has been found to be disadvantageous that beyond certain layer thicknesses, such as are required for an adequate waterproof coating, difficulties arise in achieving a continuous coagulation of the polymers. Further disadvantages connected with the process described in DE-PS No. 29 31 125 are that the coagulated particles are of a very coarse structure and display only a very slight adhesion to each other and to the substrate, so that they separate even during the coagulation phase and soil the machinery that is used. In the case of finished textiles, too, the coating is extracted or dissolved to a great extent during dry cleaning and washing. A particular disadvantage is a colour change (grey haze) that is seen after the coated web material has been dried.

It is the object of the present invention to improve the durability of a polyurethane coating that is applied to such a web material and thus arrive at a more durable impermeability to water of the coated material, which will withstand dry cleaning and washing.

It is also an object of the present invention to provide an improved process for coating textiles with aqueous polyurethane dispersions that can be managed with smaller quantities of liquid and is less costly with regard to the apparatus that is required to implement said process.

These objects have been solved by in coating a textile structure, wet-on-wet, with at least two aqueous polyurethane dispersions of opposite charge, this being done by a known and conventional in-line two coat technique as is used, for example, when coating with PVC plastisols; the textile structure that has been so coated is then dried and optionally waterproofed.

The polyurethane dispersions used for the process according to the present invention are commercially available and are produced by known methods, such as are described, for example, in DE-OS No. 29 31 044. They contain polyurethanes having ionic or ionizable groups that are bonded covalently onto the principle polymer chain and allow the polymers to disperse in water. If the covalently bonded groups that enhance solubility are carboxyl or sulfonic acid groups or salts of these, one refers to anionic dispersions. If the group that enhances solubility and is covalently bonded to the polymer chain is an amino group or a salt of this, then this is a cationic polyurethane dispersion.

In many instances, such dispersions contain between 10 and 60%-wt solids, normally between 20 and 50%-wt. The viscosity of commercially available, aqueous polyurethane dispersions can vary over a very wide range between 10 and 200,000 mPa.s. In order to match the viscosity of a paste to the coating technology that is used, it is very often necessary to reduce the viscosity of the dispersion by diluting it with water, or else raise it to the desired degree by the addition of suitable, preferably non-ionic, commercially available thickeners based on polyurethane. Such process steps present no problem to the expert who is familiar with coating technology and can determine the correct selection of the required viscosity regulator, by type and quantity, after only a few preliminary tests. Foaming problems that occur can be controlled by the addition of small quantities of anti-foaming agent. Preferably, the coating pastes will be adjusted to viscosities between 50,000 and 200,000 MaP.s. For the first coat and the second coat when using the in-line two-coat technology, the anionic and the cationic polyurethane dispersions are used in a weight ratio of 1:2 to 2:1, preferably in a weight ratio of 1:1. Especially preferred are quantities by weight for oppositely charged aqueous polyurethane dispersions such that the anionic and the cationic covalently bonded, solubility-enhancing groups are present in stochiometrically equivalent quantities.

According to the present invention, one can proceed such that the anionic dispersion is applied to the substrate as a first coat, and then, wet-on-wet, the cationic dispersion is applied, or vice versa, the cationic polyurethane is applied as the first coat and the anionic dispersion is used as the second coat, with no intermediate drying.

The first and the second coat can both be applied as a compact coat, by using the air-knife coating method, for example. However, in a preferred embodiment, the second coat can be applied on the compact first coat as foam, e.g., with a knife-over-roll coater. This foam application imparts a particularly soft and bulky feel and a very good drape to textile materials coated in this manner.

With consideration of the already quoted weight ratios of the anionic and cationic dispersions to each other, the wet coatings of anionic and cationic coating are selected in such a range that the coated material has a total dried application of between 5 and 50 g/m$^2$, preferably between 15 and 35 g/m$^2$.

After the wet-on-wet coating of the carrier material the coating is dried in the usual manner on machinery that is normally used in coating technology, at temperatures between 80° and 180° C., preferably between 120° and 140° C., and is optionally calendered lightly when still warm.

It has been found to be advantageous that material coated with polyurethane be subjected to yet another waterproofing, application preferably with the use of a fluorocarbon resin emulsion or a silicon resin emulsion.

The technical effects of coating textiles using the method according to the present invention can be seen from the following examples. Compared to known processes used in this technology, it has proved to be especially advantageous that exceptional adhesion of the coating to the substrate is provided, and this is seen in good resistance to dry cleaning and washing. No changes in colouration, with the formation of a grey film, have been observed in products produced according to the present invention.

Further advantages of the process according to the present invention as compared to the prior art are that the existing apparatuses used in the prior art for coating technology can be used without any additional machinery or investment, and time-consuming rinsing processes and the attendant burdening of waste water disposal systems with the rinse water are avoided.

The present invention also relates to textile structures produced according to the present invention and coated with polyurethane, and their use for the production of breathable clothing that is permeable to water vapour and yet is water- and wind resistant, or industrial textiles such as tenting materials or artificial leather products. The textiles so coated can be ground or abraded and thus be given a velvet or suede-like appearance without any degradation of their technical characteristics. Thus it is possible to produce artificial leather products in this way.

EXAMPLE 1

First coat:

A paste of the following composition is prepared:

100 parts/wt of an aqueous, cationic polyurethane dispersion with a solids content of 30%-wt and a viscosity of 50 mPa.s, prepared according to a known method from a polypropylene glycol with a molecular weight 1000 and a hydroxyl number of 112, from dicylohexylmethane diisocyanate and N-methyldiethanolamine as a solubility-enhancing, cationic component, and 5 parts/wt of a 50-% aqueous solution of a non-ionogenic polyurethane-based thickening agent (e.g., BORCHIGEL L 75).

The paste has viscosity of 60,000 mPa.s (Brookfield RVT, spindle 6/10 Umin$^{-1}$). The paste is applied by the air-knife method to a commercially available poplin fabric of polyester/cotton 66/33 at a weight per unit area of 160 g/m$^2$ and results in a wet application of 30 g/m$^2$.

Second coat:

Without any intermediate drying, the fabric coated in the manner described above is treated with a second coat, using a paste composed as follows:

70 parts/wt of an aqueous, anionic polyurethane dispersion with a solids content of 40%-wt and a viscosity of 300 mPa.s, produced by a known method from a polyetherpolyol (propylene oxide/ethylene oxide adduct based on glycerine with a molecular weight of 4000), from isophoron diisocyanate and dimethylolpropionic acid as a solubility-enhancing, anionic component, 1 part/wt anti-foaming agent based on magnesium stearate 23 parts/wt water, and 6 parts/wt thickening agent (BORCHIGEL L 75).

The wet application for the second coat amounts to 40 g/m$^2$.

The coated textile is then dried in a air-drying chamber for 2 minutes at 90° C. and then waterproofed. To this end it is dipped in a liquor consisting of 40 g/liter of fluorocarbon resin emulsion, squeezed off to 43% wet application, and dried and condensed for four minutes at 170° C. in a drying cabinet. The textile was then calendered on a two-roller calender, between a steel and a plastic roller, when the temperature of the steel roller amounts to 70° C., the pressure is 150 kg/cm$^2$ linear, and the operating speed is 10 m/min. The textile that is so coated has a total dry application of 21 g/m$^2$ of polyurethane. The measurement results are set out in the table.

EXAMPLE 2

Using the same procedure as in Example 1, an aqueous, anionic polyurethane dispersion is applied to a textile as a first coat, and an aqueous, cationic polyurethane dispersion applied as a second coat. Pastes of the following composition were used for this purpose:

First coat:

75 parts/wt of an aqueous, anionic polyurethane dispersion with a solids content of 40%-wt and a viscosity of 40 mPa.s, produced by a known method from a linear polyester containing hydroxyl groups and based on diethylene glycol and adipic acid with an OH number of 43, of trimethyl-1,6-hexamethylene diisocyanate and dimethylolpropionic acid as a solubility-enhancing, anionic component, 1 part/wt anti-foaming agent based on calcium stearate, 18 parts/wt water, 6 parts/wt of a 50% aqueous solution of a non-ionogenic thickening agent based on polyurethane (BORCHIGEL L 75).

Wet application: 30 g/m$^2$

Second coat:

90 parts/wt of an aqueous, cationic polyurethane dispersion with a solids content of 30%-wt and a viscosity of 50 mPa.s, produced as described in example 1, 4 parts/wt of an aqueous thickening agent solution based on polyurethane.

Wet application: 30 g/m$^2$

The finished, coated textile has a total dry application of polyurethane of 17 g/m² and displays the values set out in the table after re-waterproofing as in example 1.

EXAMPLE 3

A textile was coated by the air-knife process as described in example 1, using a coating paste of the following composition:

80 parts/wt of an aqueous, cationic polyurethane dispersion with a solids content of 30%-wt and a viscosity of 200 mPa.s, produced by a known process from a mixture of polyol components of polypropylene glycol of a molecular weight of 1000, trimethylol propane, and ethylene glycol, of dicyclohexylmethane diisocyanate and N-methyldiethanol amine as a solubility-enhancing, cationic component, 2 parts/wt anti-foaming agent based on a stearate, 5 parts/wt of a thickening agent (BORCHIGEL L 75), 13 parts/wt water.

The wet application for the first coat was 60 g/m², which corresponds to a dry application of 15 g/m².

A mixture consisting of 95 parts/wt of an aqueous anionic polyurethane dispersion with a solids content of 40%-wt, as used in example 1, 2 parts/wt foaming agent, based on a sulfosuccinamate, 3 parts/wt of a foam stabilizer based on ammonium stearate was foamed with a Mathis laboratory mixer to a foam per liter weight of 250 g and applied at a coating thickness of 0.25 mm onto the still-wet first coat using the knife-on-roll technique. The textile that was so coated was dried for 2 minutes at 90° C. in a Benz laboratory drier and then lightly calendered whilst still warm. The textile prepared in this manner was then waterproofed and re-calendered as described in example 1.

It has a total dried application of 39 g/m² and displays the values set out in the table.

EXAMPLE 4

The following paste is used in a manner similar to that set out in example 1:

First coat:

100 parts/wt of an aqueous, cationic polyurethane dispersion with a solids content of 30%-wt and a viscosity of 50 mPa.s, produced as set out in example 1, 5 parts/wt of a 50% aqueous solution of a non-ionogenic thickening agent based on polyurethane (e.g., BORCHIGEL L 75).

The wet application amounts to 30 g/m².

Second coat:

75 parts/wt of an aqueous, anionic polyurethane dispersion with a solids content of 40%-wt and a viscosity of 40 mPa.s, produced by a known method from a linear polyester containing hydroxyl groups and based on diethylene glycol and adipic acid, with an OH number of 43, from trimethyl-1,6-hexamethylene diisocyanate and dimethylolpropionic acid as a solubility-enhancing, anionic component, 1 part/wt of an anti-foaming agent based on calcium stearate, 18 parts/wt water, 6 parts/wt of a 50% aqueous solution of a non-ionogenic thickening agent based on polyurethane.

The wet application amounts to 25 g/m²,

After processing as in example 1, the total dry application of polyurethane amounts to 16.5 g/m². The measurement results are set out in the table.

Coating Trials with Polyurethane Dispersions

| Example | Application g/m² | Water Column in mm | Water Vapour Permeability mg/cm2/hr | Spray Test | After one dry cleaning: Weight loss % | Water Column in mm | Spray test |
|---|---|---|---|---|---|---|---|
| 1 | 21 | 700–730 | 9.44 | 90–100 | 9.7 | 730 | 90–100 |
| 2 | 17 | 600–630 | 12.40 | 90–100 | 6.7 | 600–650 | 90–100 |
| 3 | 39 | 800–820 | 10.30 | 90–100 | 7.5 | 850–870 | 90–100 |
| 4 | 16.5 | 630–690 | 14.62 | 90–100 | 7.2 | 630–690 | 90–100 |

Legend
The following methods were used in order to determine the measured values:
Water column as in DIN 53 886
Water vapour permeability as in DIN 53 333
Spray test as in AATCC 22-1974
Dry cleaning was carried out for 8 minutes in a BOEWE R8 dry cleaning plant, using perchorlethylene with the addition of 2 g/litre dry cleaning enhancer, and a reversed cycle during additional load. The moisture above the bath amounts to 65% relative air humidity. Rinsing was then carried out in clear perchlorethylene for 3 minutes, and this was followed by spin drying and drying.

We claim:

1. In the production of a textile surface coated with polyurethane, by wet coating of the textile material with an aqueous, ionic dispersion of a polyurethane containing no free isocyanate groups, with covalently bonded, solubility-enhancing ionizable groups, and subsequent drying of the coated material, the improvement which comprises applying to the textile surface an aqueous, cationic dispersion of a polyurethane with covalently bonded, solubility-enhancing, cationic groups and an aqueous, anionic dispersion of a polyurethane with covalently bonded, solubility-enhancing, anionic groups.

2. A process according to claim 1, wherein the cationic dispersion is applied before the anionic dispersion.

3. A process according to claim 1, wherein the anionic dispersion is applied before the cationic dispersion.

4. A process according to claim 1, wherein the anionic and the cationic dispersions are applied in a weight ratio of 1:2 to 2:1.

5. A process according to claim 1, wherein the anionic and the cationic dispersions are applied in a weight ratio of about 1:1.

6. A process according to claim 1, wherein the cationic and the anionic dispersions are applied in such quantities that the anionic and the cationic, covalently bonded, solubility-enhancing groups are present in approximately stochiometrically equivalent quantities.

7. A process according to claim 1, wherein the anionic and the cationic dispersions are applied as compact layers.

8. A process according to claim 1, wherein the first dispersion is applied as a compact layer and the second dispersion is applied as a foamed layer.

9. A process according to claim 1, wherein each of the dispersions has a solids content of 10 to 60%-wt.

10. A process according to claim 1, wherein each of the dispersions has a solids content of 20 to 50%-wt.

11. A process according to claim 1, wherein each of the dispersions has a viscosity of 10 to 200,000 mPa.s.

12. A process according to claim 1, wherein each of the dispersions has a viscosity of 200 to 100,000 mPa.s.

13. A process according to claim 1, wherein the coated textile surface carries 5 to 50 $g/m^2$ of polyurethane.

14. A process according to claim 1, wherein the coated textile surface carries 15 to 35 $g/m^2$ of polyurethane.

15. A polyurethane-coated textile produced by the process of claim 1.

* * * * *